US006979007B1

(12) United States Patent
Hosoda

(10) Patent No.: US 6,979,007 B1
(45) Date of Patent: Dec. 27, 2005

(54) TRUCK STRUCTURE OF SKATEBOARD

(75) Inventor: Togo Hosoda, Kanagawa (JP)

(73) Assignee: Deux Nee Co., Ltd., Kanagawa (JP)

( * ) Notice: Subject to any disclaimer, the term of this patent is extended or adjusted under 35 U.S.C. 154(b) by 0 days.

(21) Appl. No.: 10/910,744

(22) Filed: Aug. 3, 2004

(51) Int. Cl.[7] ..... B62M 1/00
(52) U.S. Cl. ..... 280/87.042; 280/87.041
(58) Field of Search ..... 280/87.042, 87.041, 280/11.27, 11.28

(56) References Cited

U.S. PATENT DOCUMENTS 4,120,510 A * 10/1978 Hillard ..... 280/87.042
4,155,565 A * 5/1979 de Caussin et al. ..... 280/87.042
5,263,725 A * 11/1993 Gesmer et al. ..... 280/11.28
5,868,408 A 2/1999 Miller
6,123,348 A * 9/2000 Miller ..... 280/87.042
6,793,224 B2 * 9/2004 Stratton ..... 280/87.042

FOREIGN PATENT DOCUMENTS

EP 1 080 751 A1 3/2001

* cited by examiner

*Primary Examiner*—Hau Phan
(74) *Attorney, Agent, or Firm*—Darby & Darby

(57) ABSTRACT

A truck (20) journaling a wheel (W) is turnably supported leftward and rightward from a neutral position and, at the same time, a support (1) for returnably urging the truck (20) to the neutral position is provided. The support (1) comprises a weighting table (2) fixed to a deck (D) and a support table which is pivotally connected to this weighting table (2) and detachably and attachably fixes the truck. A link piece (7) is pivotally connected between the weighting table 2 and the support table (10) and, when the support table (20) is turned leftward and rightward from the neutral position, the support table (10) is allowed to return to the neutral position due to a repulsive force of a coil spring (S).

6 Claims, 7 Drawing Sheets

(a)

(b)

(a)

(b)

TRUCK STRUCTURE OF SKATEBOARD

BACKGROUND OF THE INVENTION

1. Field of the Invention

The present invention relates to a truck structure of a skateboard and, more particularly, to a structure on which a truck is detachably and attachably mounted.

2. Description of the Related Art

Heretofore, as one example of the truck structure of the skateboard, a truck structure has been known. It changes a rudder angle of a wheel W leftward and rightward corresponding to a deflection of the truck, as shown in FIG. 7.

In such a truck structure 30, a top face of a truck bearer portion 31 which journals the wheel W is formed in the disk-shape, and contacts a disc shaped-bottom face of a weighting table base portion 32 fixed to a deck D, and is pivotally connected to P at a central position.

Further, the weighting table base portion 32 is connected to a box portion 33 which stores a coil spring S, and an elastic force of the coil spring S can be adjusted by an adjustment bolt 35 which penetrates a hollow of the coil spring S.

Further, the top face of the truck bearer portion 31 is provided with a protrusion portion 36, on the upper part of which is provided a protrusion axis 37, and the protrusion portion 36 is engaged with a long hole 38 formed almost in the shape of a fan on the top face of the weighting table base portion 32, and is allowed to slide within the range of the long hole 38.

A base end of a link piece 39 which penetrates the adjustment bolt 35 within the box portion 33 and is pivotally connected thereto and pushingly abuts against a top end side of the coil spring S, is pivotally connected to the protrusion axis 37.

The protrusion axis 37 placed in a neutral position is arranged on the axis line of the adjustment bolt 35. When a force works to make turns leftward and rightward, both the protrusion portion 36 and the protrusion axis 37 turn leftward and rightward within a constant range, and gradually move away from the axis line of the adjustment bolt 35. Therefore, accompanied with this movement, the link piece 39 is pulled and compresses the coil spring S to make it repulsive.

When no force is applied leftward and rightward on the truck, the wheel W is returned to the neutral position through the link piece 39 by an elastic resettability of the coil spring S.

Hence, a conventional structure is integrally provided with a truck and a mechanism which allows the truck to turn leftward and rightward and, therefore, a modification or a replacement of a truck portion is not easily performed and there has been a problem in that a maintenance, a tuning, or the replacement and the like of the truck are hard to perform.

Further, a pivotal stroke of the link piece 39 is regulated by the long hole 38 formed at the top face of the weighting table base portion 32, and the protrusion axis 37 is required to be provided on the protrusion portion 36 and, thus, the structure has been made complicated. In addition, the crossing of the axis lines at both ends of the link piece 39 imposes a torsional load to the link piece 39, and this has necessitated a sufficient strength to be given to the link piece 39.

Moreover, since the turning of the truck bearer 31 for the weighting table base portion 32 concentrates a stress onto the pivot P, it tends to be fatigued and a problem may occur in its durability.

SUMMARY OF THE INVENTION

Hence, it is an object of the present invention to provide a truck structure of a skateboard capable of detachably and attachably mounting an independent truck on a support table of a support which has a built-in rudder mechanism.

It is another object of the present invention to provide the truck structure of the skateboard, which is simple in a structure and high in reliability.

In order to solve the above-described problem, in the truck structure of the skateboard provided with the support for turnably supporting the truck leftward and rightward from a neutral position and, at the same time, returnably urging the truck to the neutral position, the present invention is carried out in such a manner that the support comprises a weighting table fixed to a deck, and a support table which is pivotally connected to this weighting table and is made turnable leftward and rightward and detachably and attachably fixes the truck, wherein a link piece is pivotally connected between the weighting board and the support table and, when the support table turns leftward and rightward from the neutral position, the support table is returned to the neutral position by a repulsive force of an elastic member compressed by the link piece.

In this way, according to the present invention, since the truck can be detachably and attachably mounted on the support, the user can select and use an optimum truck from among the complete trucks having a separate entity.

Further, even at the time of a tuning-up, a repair and a replacement of the truck, these operations can be easily performed by dismounting the truck.

Further, at the time of turns, the support is turned with a cap-shaped bearer portion put on there so as to cover the top face and a side peripheral face of the cylindrical bearer portion, so that there is no risk of a damage even when an external force is imposed to the direction other than pivoting and it is, therefore, possible to make stable turns.

Furthermore, since the link piece is pivotally connected only to a protrusion axis protruded on the top face of the bearer portion and an adjustment bolt, the structure is simple and good in reliability.

DESCRIPTION OF THE PREFERRED EMBODIMENT

The best mode of a preferred embodiment of a truck structure of a skateboard of the present invention will be described below with reference to the drawings.

Figure 3:
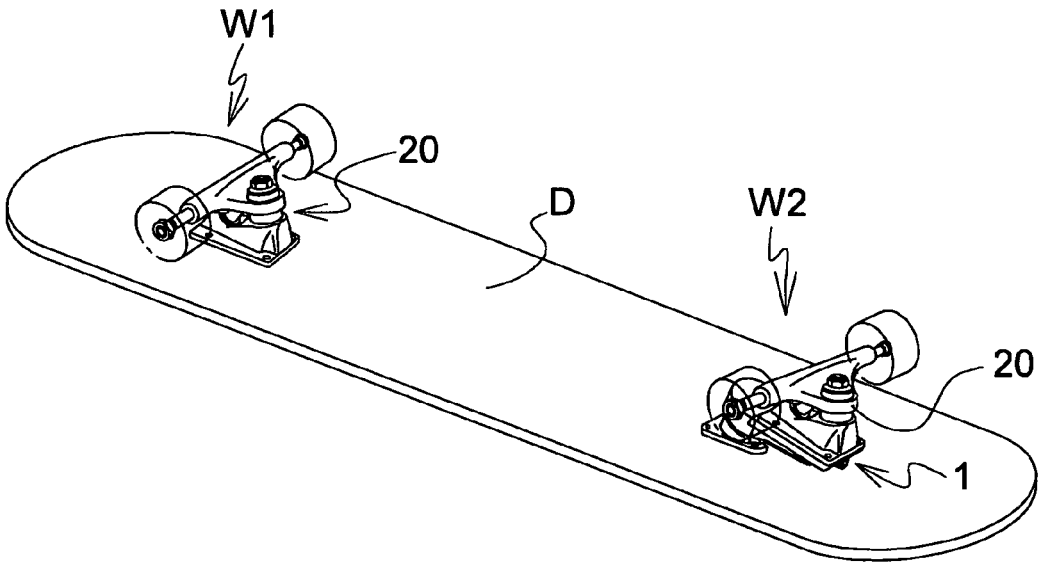
FIG. 3 is a perspective view seen from the bottom face side of a skateboard using this truck structure.

A skateboard as shown in FIG. 3 comprises a structure, which mounts a front wheel device W1 comprising a truck 20 which journals a front wheel, and a rear wheel device W2 having the truck 20 which journals a rear wheel to the deck D.

The truck structure of this embodiment in the case of the illustrated example, is used as the rear wheel device, in the present invention. It may be used either for the front wheel side or the front and the rear wheel side.

Figure 2:
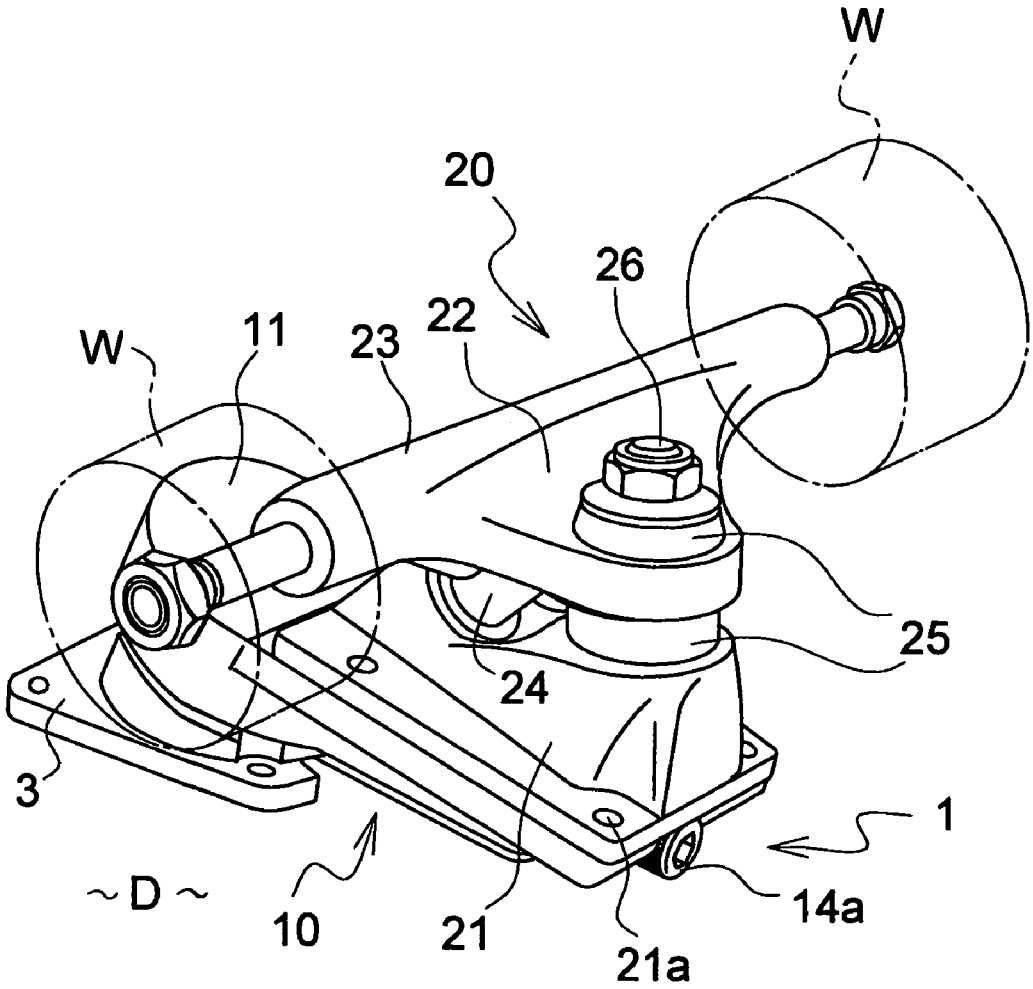
FIG. 2 is a perspective view seen from the bottom face side showing the truck structure mounting a truck on the support.

This truck structure, as illustrated in FIG. 2, comprises a structure provided with a support 1 which turnably supports the truck 20 which journals a wheel W as a wheel, leftward and rightward from a neutral position and, at the same time, urges the truck 20 to a neutral direction.

Figure 1:
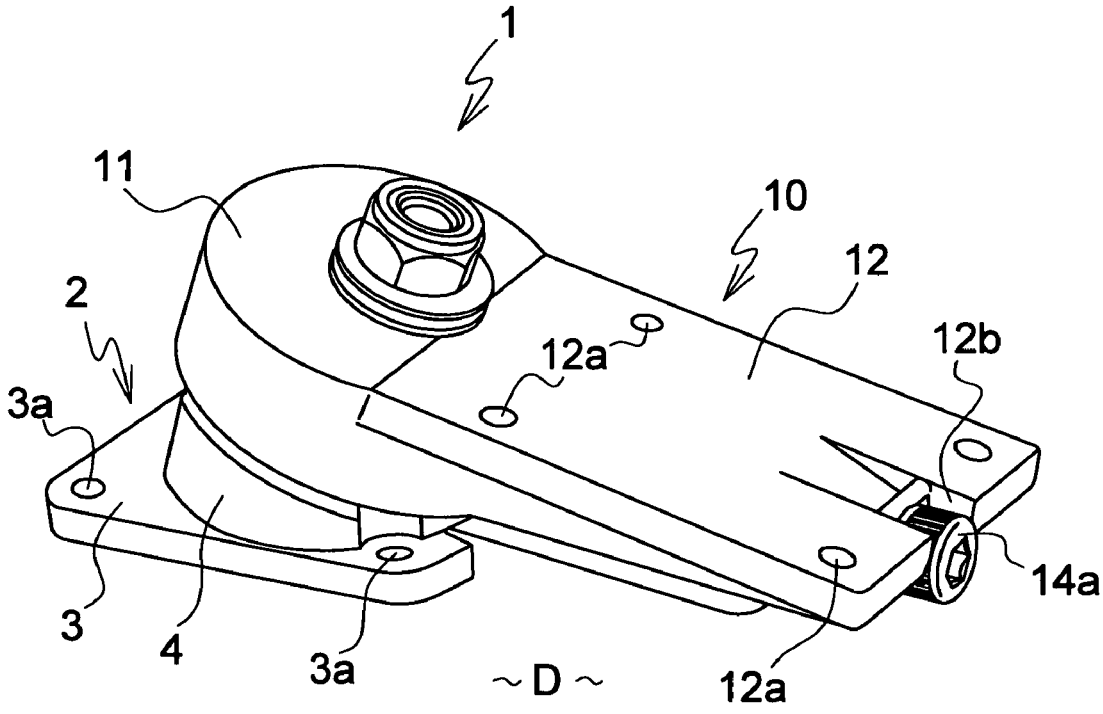
FIG. 1 is a perspective view seen from a bottom face side showing an embodiment of a support of a truck structure.

The support 1, as illustrated in FIG. 1, comprises a weighting table 2 fixed to a deck D and a support table 10 which is pivotally connected to the weighting table 2 and detachably and attachably fixes the truck 20.

Figure 4:
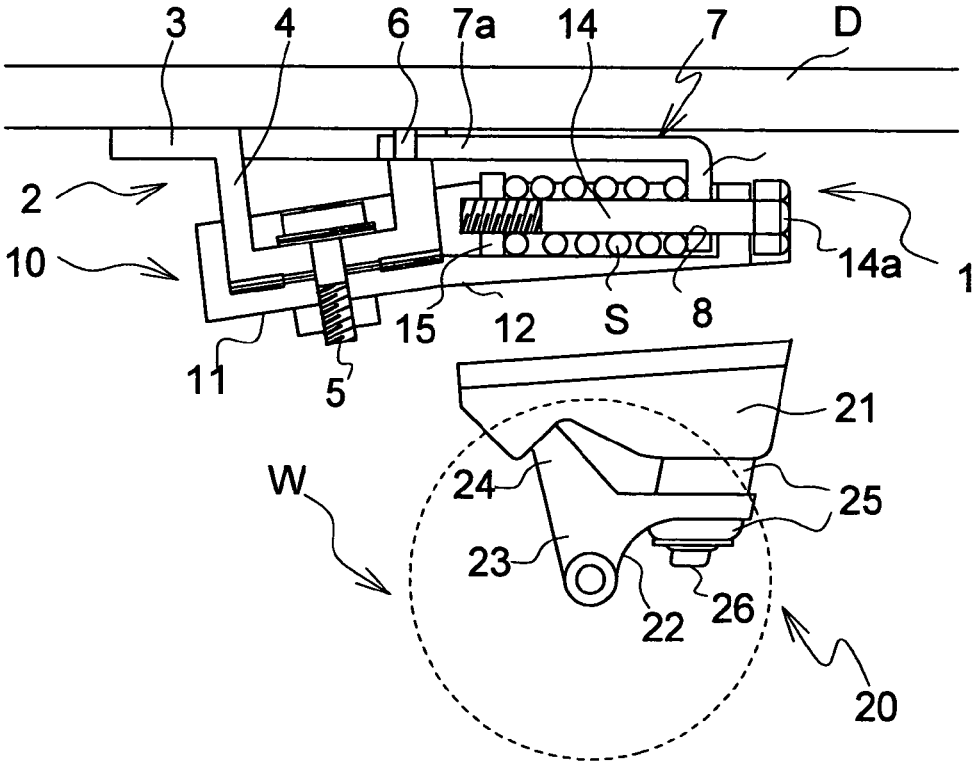
FIG. 4 is a cross-sectional view of the support of the truck structure.

The weighting table 2, as more distinctly illustrated in FIG. 4, comprises a base portion 4 cylindrically protruded on a base piece 3 which is fixed to the deck D by screws through holes 3*a* and the like.

In the case of the illustrated example, the base portion 4 is erected by slightly inclining to the side on which the truck 20 is mounted.

A backside 3*b* of the base piece 3 is notched in a fan shape with a top face (the deck D side) of the base portion 4 exposed in a circular arc shape, and a protrusion axis 6, which is pivotally connected to one end of a link piece 7 to be described later, is protruded (see FIG. 5(A)).

Next, the support table 10 comprises a cap-shaped bearer 11 which is set at the same concentric diameter as that of the base portion 4, and a mounting piece portion 12, which extends from the bottom face (the top face in FIG. 1) of the bearer portion 11 to one side, and a box shaped storage portion 13 is integrally formed on the top face (the deck D side) of the mounting piece portion 12.

The bearer portion 11 has an C-shaped peripheral wall in its cross section, and the storage portion 13 comprises an almost U-shaped peripheral wall in its cross section, and the peripheral walls of the former and the latter become integrated so that a hollow portion between the bearer portion 11 and the storage portion 13 is communicated with each other, and the surface of the bearer portion 11 is formed almost in the shape of a keyhole.

The bearer portion 11 is outwardly fitted so as to cover the top face and the side peripheral face of the base portion 4, and pivotally connects the base portion 4 and the bearer 11 by the pivot 5 along the axis line. Therefore, the bearer portion 11 is connected rotatably leftward and rightward with the base portion as a center.

The mounting piece portion 12 is flat in the undersurface, and is arranged so as to be inclined to the deck D.

Mounting holes 12*a* for fixing the truck 20 are drilled on the four corners of the mounting piece portion 12. A known truck 20 is used as the truck 20 to be fixed to this mounting piece portion 12.

The truck 20, as illustrated in FIG. 2 and FIG. 4, one example of which is shown in the present embodiment, comprises a structure in which a main body portion 22 having a hanger 23 journaling the wheel W and a pivot 24 is fixed to a pedestal portion 21 having a pivot hole by a pin 26 or a bolt through bush rubbers 25.

Mounting holes 21*a* drilled in the pedestal portion 21 are aligned to the mounting holes 12*a* of the mounting piece portion 12, and bolts are passed through there and tightly fastened by nuts and the like, thereby detachably and attachably fixing the truck 20 to the support table 10.

Here, while the truck 20 is directly fixed to the support table 10, a known spacer (not shown) may be interposed between the mounting piece portion 12 and the support table 10 so as to mount the truck 20.

In the present embodiment, although the trucks 20 used in the front wheel device and the rear wheel device of the skateboard are regarded as having the same structure, both of the devices may be of different forms and structures.

Next, a coil spring S is fitted into the storage portion 13.

Further, the adjustment bolt 14 with a top end thereof cut with threads is screwed at the center of the rear wall 13*a* opposed to the open side in the peripheral wall of the storage portion 13, and extends longitudinally through the center of the storage portion 13. A head portion 14*a*, in which a knurl is formed, is hung at the rear wall 13*a*.

Here, a rear end center 12*b* of the mounting piece portion 12, which corresponds to a position of the head portion 14*a* of the adjustment bolt 14, is notched so that it does not hit against the head portion 14*a*.

This adjustment bolt 14 extends by penetrating a hollow of the center of the coil spring S within the storage portion 13, and a disc nut 15 formed in a pentagonal shape is screwed on the top end of the adjustment bolt 14, so that it does not rotate within the storage portion 13.

Hence, by rotating the head portion 14*a* of the adjustment bolt 14, the disc nut 15 can be screwed back and forth along the axial direction of the adjustment bolt 14.

This disc nut 15 pushingly abuts against the top end of the coil spring S, and repulsively compresses the coil spring S together with the link piece 7 to be described later.

Next, the link piece 7 is placed between the weighting table 2 and the support table 10.

This link piece 7 is formed of an almost L-shaped plate piece in its cross-section, and the top end of a longitudinal piece 7*a* thereof is screwed to a protrusion axis 6 which is fixed on the top face of the base portion 4, and a hole 8 is drilled on a bent short piece 7*b* and covers the coil spring S within the storage portion 13, and the adjustment bolt 14 is inserted at a position adjacent to the rear end of this coil spring S, and the rear end of the link piece 7 is pivotally connected to the bolt 14.

Hence, a rotation to the fastening direction of the head portion 14*a* of the adjustment bolt 14 gradually compresses the coil spring S held between the disc nut 15 and the bent short piece 7*b* of the link piece 7 due to an advancement of the disc nut 15 toward the link piece 7, and a reverse rotation gradually weakens the compression due to a retreat of the disc nut 15, thereby making it possible to perform a fine adjustment of an elastic force.

Next, an action of the truck structure of the skateboard will be described.

Figure 5:
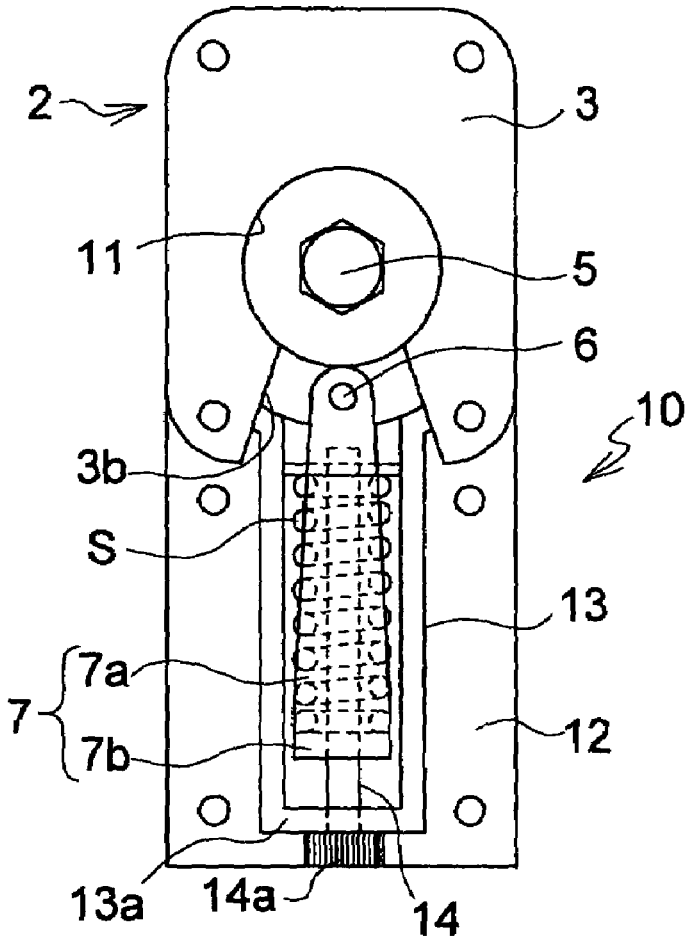
FIG. 5(A) is a bottom face drawing of the support at a neutral position.
FIG. 5(B) is a cross-sectional view showing a link piece within a storage portion pivotally connected to an adjustment bolt at the same position.
Figure 5:
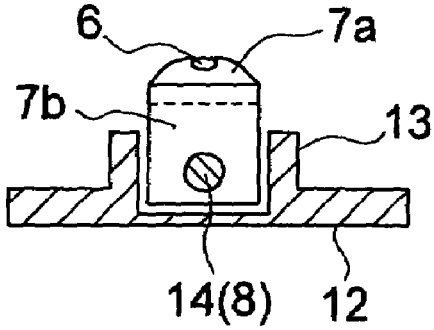

A gravitational movement or a motion of a player on the deck D from the neutral position shown in FIG. 5 causes a biased force and, according to this force, together with the support table 10 of the support 1, the truck 20 makes a turn to one side with the pivot 5 as a supporting point.

Figure 6:
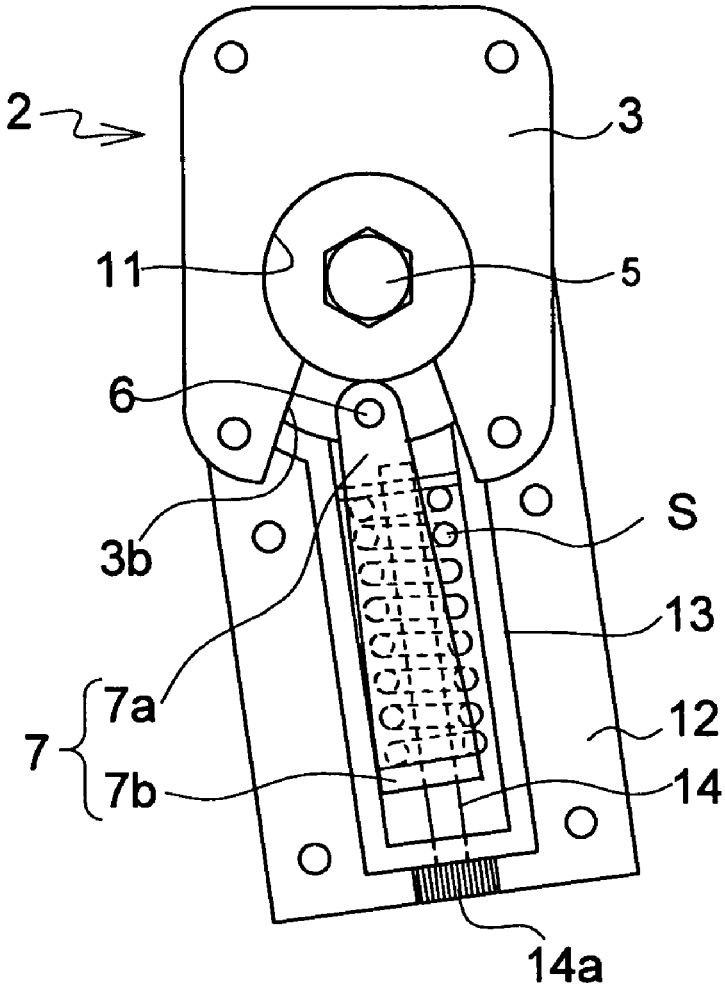
FIG. 6(A) is a bottom view of the support at a position turned to one side.
FIG. 6(B) is a cross-sectional view showing the link piece within the storage portion pivotally connected to the adjustment bolt at the same position.
Figure 6:
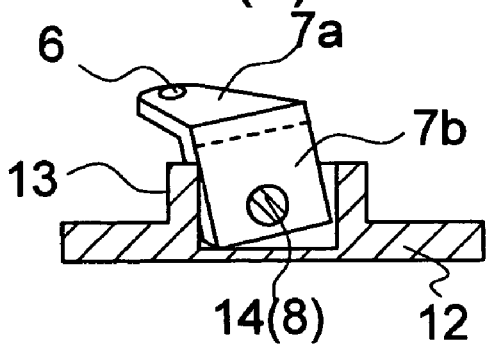
Figure 7:
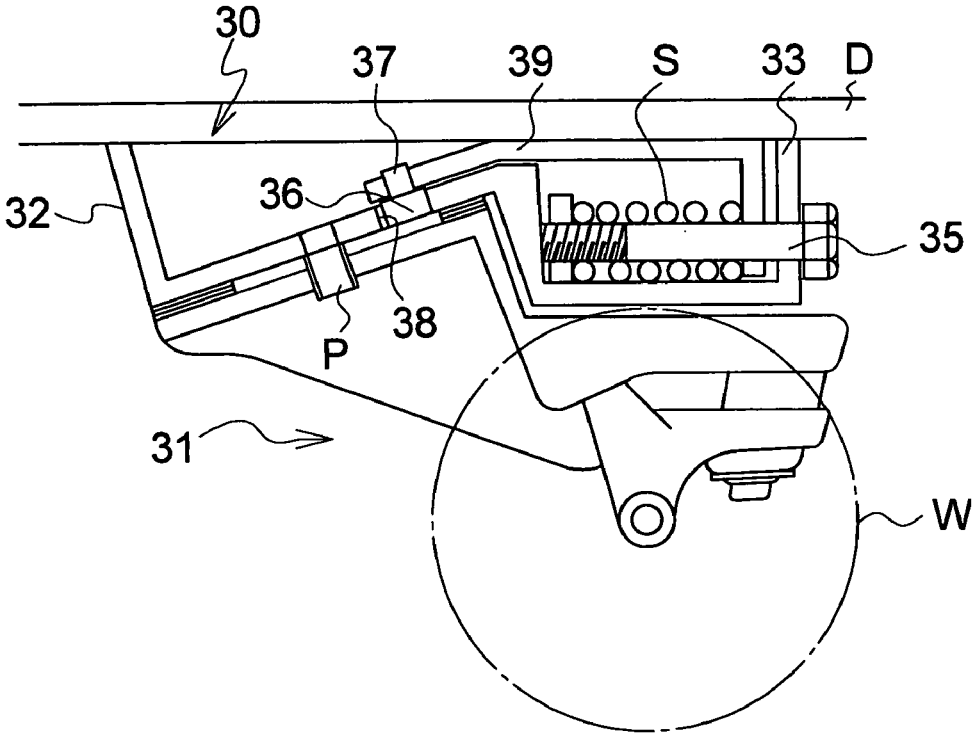
FIG. 7 is a cross-sectional view showing a conventional truck structure.

The leftward and rightward pivotal movement of the support table 10 allows the link piece 7 to be moved and displaced at the same time (See FIG. 6).

Here, the protrusion axis 6 at the neutral position shown in FIG. 5 is arranged on the axis line of the adjustment bolt 14 so as to maintain the shortest distance. At the turn position illustrated in FIG. 6, the protrusion axis 6 gradually moves away from the axis line of the adjustment bolt 14 in proportion to the pivotal movement of the support table 10, so that the link piece 7, both ends of which are pivotally connected to the protrusion axis 6 and the adjustment bolt 14, is pulled to the direction in which the coil spring S is compressed.

In this way, turns made leftward and rightward from the neutral position allow the repulsive force of the coil spring S to become stronger as a rudder angle is made larger, thereby reducing an external force which acts upon the turn direction. On the other hand, an elimination of the external force applied on the turn direction allows the truck 20 to return to the neutral position by the elastic repulsive force stored in the coil spring S.

Here, since the support 1 of the present embodiment, as shown in FIG. 1 and FIG. 2, sets the mounting piece portion 12 of the support table 10 at the inclined surface, amounting angle to the deck D of the truck 20 changes. However, the mounting piece portion 12 may be provided so as to be horizontal to the deck.

What is claimed is:

1. A truck structure of a skateboard comprising:

a truck for supporting a wheel;

a support for turnably supporting the truck leftward and rightward from a neutral position and returnably urging the truck to the neutral position, wherein the support comprises a weighting table fixed to a deck of the skateboard and a support table which is pivotally connected to this weighting table and turnable leftward and rightward; said support table being detachably and attachably fixed to said truck, and a link piece being pivotally connected between the weighting table and the support table and, when said support table turns leftward and rightward from the neutral position, the support table is returned to the neutral position by a repulsive force of an elastic member compressed by the link piece.

2. The truck structure of the skateboard according to claim 1, further comprising:

a cap-shaped pedestal portion having a base portion, the weighting table protruding cylindrically therefrom, said support table having the same concentric diameter as said base portion and is pivotally and movably engaged with the base portion; and a fixture portion which extends from a bottom face of the base portion to one side and detachably and attachably mounts the truck, wherein said base portion is externally engaged with the pedestal portion, and the fixture portion is pivotally connected along an axis line of said base portion.

3. The truck structure of the skateboard according to claim 2, further comprising:

a storage portion provided on a bottom face side of the fixture portion of the support table and storing a coil spring as the elastic member;

an adjustment bolt, which extends by penetrating a hollow of the coil spring, being screwed on a peripheral wall of said storage portion; and a nut which pushingly abuts against an end portion of and being moveable back and forth on the adjustment bolt.

4. The truck structure of the skateboard according to claim 3, wherein the link piece comprises an L-shaped plate piece, and a base end side of the plate is screwed on a protrusion fixed on a bottom side of said base portion, and a top end side screwed on the adjustment bolt of said plate is positioned within said storage portion and receives said adjustment screw therethrough within said storage portion and, at the same time, said top end side pushingly abutting against a rear end side of the coil spring, wherein said protrusion is arranged on an axis line of the adjustment bolt at the neutral position and, when the support table is rotated, the protrusion moves away from said axis line, and the coil spring is repulsively compressed by the link piece.

5. The truck structure of the skateboard according to claim 1, wherein the truck comprises a hanger journaling a wheel, and a main body portion having a pivot fixed to a pedestal portion having a pivot hole by a king pin trough bush rubbers.

6. The truck structure of the skateboard according to claim 1, wherein the pedestal portion of the truck is fixed to one side of the deck of the skateboard and is made as a fixed wheel, and the support is fixed to the other side of the deck, and the truck is detachably and attachably fixed on the support so as to make it as a rudder wheel.

* * * * *